US011325803B2

(12) United States Patent
Picchi et al.

(10) Patent No.: US 11,325,803 B2
(45) Date of Patent: May 10, 2022

(54) GLUING DEVICE OF AN END EDGE OF A LOG

(71) Applicant: GAMBINI S.p.A., Milan (IT)

(72) Inventors: Fabio Picchi, Lammari (IT); Giovanni Buffa, Ponte Buggianese (IT)

(73) Assignee: GAMBINI S.p.A., Milan (IT)

( * ) Notice: Subject to any disclaimer, the term of this patent is extended or adjusted under 35 U.S.C. 154(b) by 22 days.

(21) Appl. No.: 16/819,379

(22) Filed: Mar. 16, 2020

(65) Prior Publication Data

US 2020/0299096 A1 Sep. 24, 2020

(30) Foreign Application Priority Data

Mar. 18, 2019 (IT) ..... 102019000003885

(51) Int. Cl.
*B65H 37/02* (2006.01)
*B65H 19/29* (2006.01)
*B05C 1/02* (2006.01)

(52) U.S. Cl.
CPC ..... *B65H 37/02* (2013.01); *B05C 1/027* (2013.01); *B65H 19/29* (2013.01);
(Continued)

(58) Field of Classification Search
CPC ..... B65H 2301/41442; B65H 2301/41484; B65H 2301/414433; B65H 2301/414436; B65H 19/29
See application file for complete search history.

(56) References Cited

U.S. PATENT DOCUMENTS 5,716,489 A 2/1998 Biagiotti
6,143,111 A 11/2000 Biagiotti
(Continued)

FOREIGN PATENT DOCUMENTS

EP 1 609 534 A2 12/2005
EP 1 609 534 A3 12/2005
(Continued)

OTHER PUBLICATIONS

Italian Search Report dated Dec. 3, 2019 in Italian Application 102019000003885 filed on Mar. 18, 2019 (with English Translation of Categories of Cited Documents), 4 pages.

*Primary Examiner* — George R Koch
*Assistant Examiner* — Christopher C Caillouet
(74) *Attorney, Agent, or Firm* — Oblon, McClelland, Maier & Neustadt, L.L.P.

(57) ABSTRACT

A gluing device of an end edge of a log including an introduction assembly into the gluing device of a log, a handling assembly for a log associated to detection device of the end edge and including a pair of rolls for advancement and holding in rotation of the log, a glue dispensing assembly and a transfer assembly of the log including a transfer plane positioned downstream of the lower handling roller. The glue dispensing assembly is placed in series between the lower handling roll and the transfer plane and includes a transverse tank for the glue, housing cyclically movable glue transfer members. The transverse tank is provided with an upper cover provided with a plurality of openings provided in succession side by side at a set distance along a transverse row. The movable glue transfer members include a plurality of tips provided in succession along a transverse row, alternatively projecting through the relevant openings and retracted within the transverse tank because of the cyclical movement.

9 Claims, 5 Drawing Sheets

(52) U.S. Cl.
CPC ..... *B65H 2301/414421* (2013.01); *B65H 2301/414433* (2013.01); *B65H 2406/35* (2013.01)

(56) References Cited

U.S. PATENT DOCUMENTS

| | | | | |
|---|---|---|---|---|
| 6,682,623 | B1 * | 1/2004 | Biagiotti | B65H 19/29 156/187 |
| 2005/0284557 | A1 | 12/2005 | Gambini | |
| 2007/0246595 | A1 * | 10/2007 | Tsai | B65H 19/2269 242/532.3 |
| 2009/0214757 | A1 | 8/2009 | Gambini | |
| 2016/0221029 | A1 * | 8/2016 | Gambini | B65H 37/02 |

FOREIGN PATENT DOCUMENTS

| | | | |
|---|---|---|---|
| EP | 2 096 060 | A2 | 9/2009 |
| EP | 2 096 060 | A3 | 9/2009 |
| EP | 3 053 863 | A1 | 8/2016 |

* cited by examiner

GLUING DEVICE OF AN END EDGE OF A LOG

The present invention refers to a gluing device of an end edge of a log.

Through the deposition of glue a gluing device of an end edge of a log performs the closing of the end edge of rolls of paper for domestic use, toilet paper and the like, usually known as "logs", previously realized by a rewinding machine by winding one or more veils of paper onto a cardboard core. The log with the end edge firmly constrained through a certain amount of glue is then cut into lots of small rolls in a cutting machine.

In all gluing devices of an end edge the search for the end edge is performed by photocells, which is opened with respect to the log by an air blow.

From the 1980s the first gluing devices performed the search for the end edge on the log transfer plane by means of a photocell positioned above the plane. During the rotation of a pair of rollers between which the log was housed, an air blow opened the log in order to find the edge. The edge was opened on a plane and subsequently the dispensing of glue was performed for example on the open edge by means of the nozzles above. The dispensing of glue can be performed alternatively by effect of tipping the previously opened log, that is to say after having unwound the end edge, on a dispensing device of a strip of glue. The reclosing of the edge on the log, preferably with the application of a light pressure, in both cases ensures the gluing of the edge on the log.

In these gluing devices the gluing station, downstream of the edge searching station, is therefore disadvantageously distant from the edge searching station. Furthermore, these gluing devices have the criticality of having to control the phasing of the edge, unwound at a set distance, during transfer on the plane.

The need to control the phasing has led to the provision of a rephasing station, comprising a pair of rollers, positioned between the edge searching station and the glue dispensing.

Subsequently, gluing devices for end edges were developed with only one station, in which the log is opened by an air blow during the rotation of the log between two rollers. The searching of the edge is done in a hole beneath the log transfer plane by photocells arranged horizontally beneath the transfer plane. Subsequently, the dispensing of glue was performed for example on the open edge by means of nozzles positioned beneath the plane, or by effect of tipping the previously opened log, that is to say after having unwound the end edge, on a dispensing device of a strip of glue. The reclosing of the edge on the log, preferably with the application of a light pressure, in both cases ensures the gluing of the edge on the log.

The gluing devices with only one station are advantageously more compact and have fewer problems during the edge phasing.

An example of gluing devices of an end edge with only one station is given in document EP-3 053 863 A1, which shows the application of glue by means of nozzles on the unwound edge beneath the transfer plane.

Another critical aspect relating to gluing devices for end edge concerns the need to have machines that are able to adapt to different diameters of the logs being processed. The variations in diameter are given by the different length of paper wound, and by the type of logs wound, for example toilet paper or kitchen paper.

The processing of logs of toilet paper of small diameter is also particularly critical, as these require the minimising of the size of the openings present along the log transfer plane, to prevent the accidental falling of the log itself, and for which the length of the unwound edge, proportional to the diameter, is minimum.

The object of the present invention is to realise a gluing device of an end edge of a log which resolves the technical problems disclosed above in terms of the compactness of the machine and the correct phasing of the unwound end edge.

Another object of the present invention is to realise a gluing device of an end edge of a log that allows the precise and simple adaptation to the diameter of the logs being formed.

Another object of the present invention is to realise a gluing device of an end edge of a log which is simple and functional, with low costs.

These objects according to the present invention are achieved by realising a gluing device of an end edge of a log as set out in the independent claims.

Further features are provided in the dependent claims.

The features and advantages of a gluing device of an end edge of a log according to the present invention will become clearer from the following description, which is to be understood as exemplifying and not limiting, with reference to the appended schematic drawings, wherein.

figures from 5A to 5D schematically show the gluing phases of the end edge performed on the gluing device to which the present invention relates.

Figure 1:
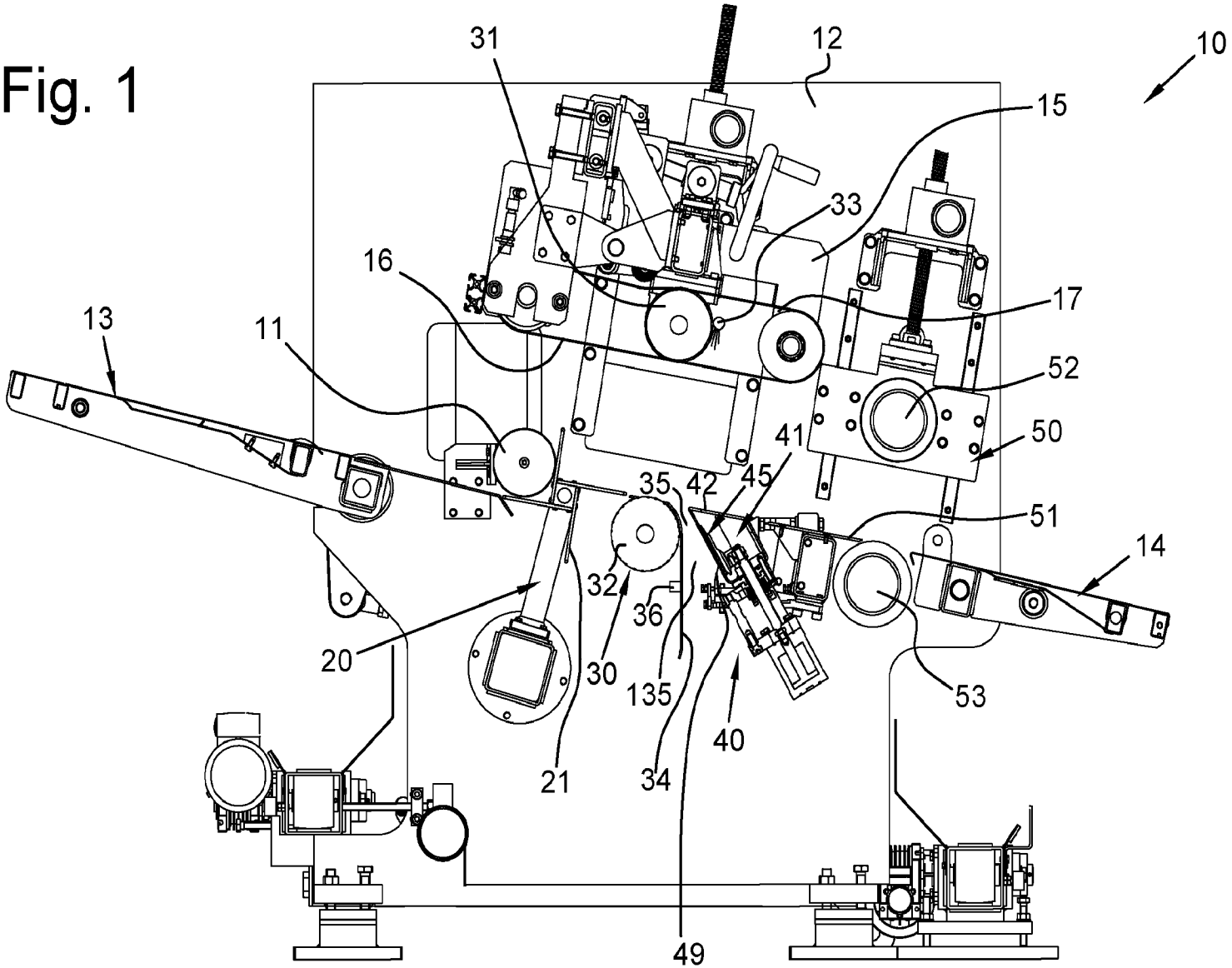
FIG. 1 is a side elevation view, partially in section, of a gluing device of an end edge of a log according to the invention.
Figure 2:
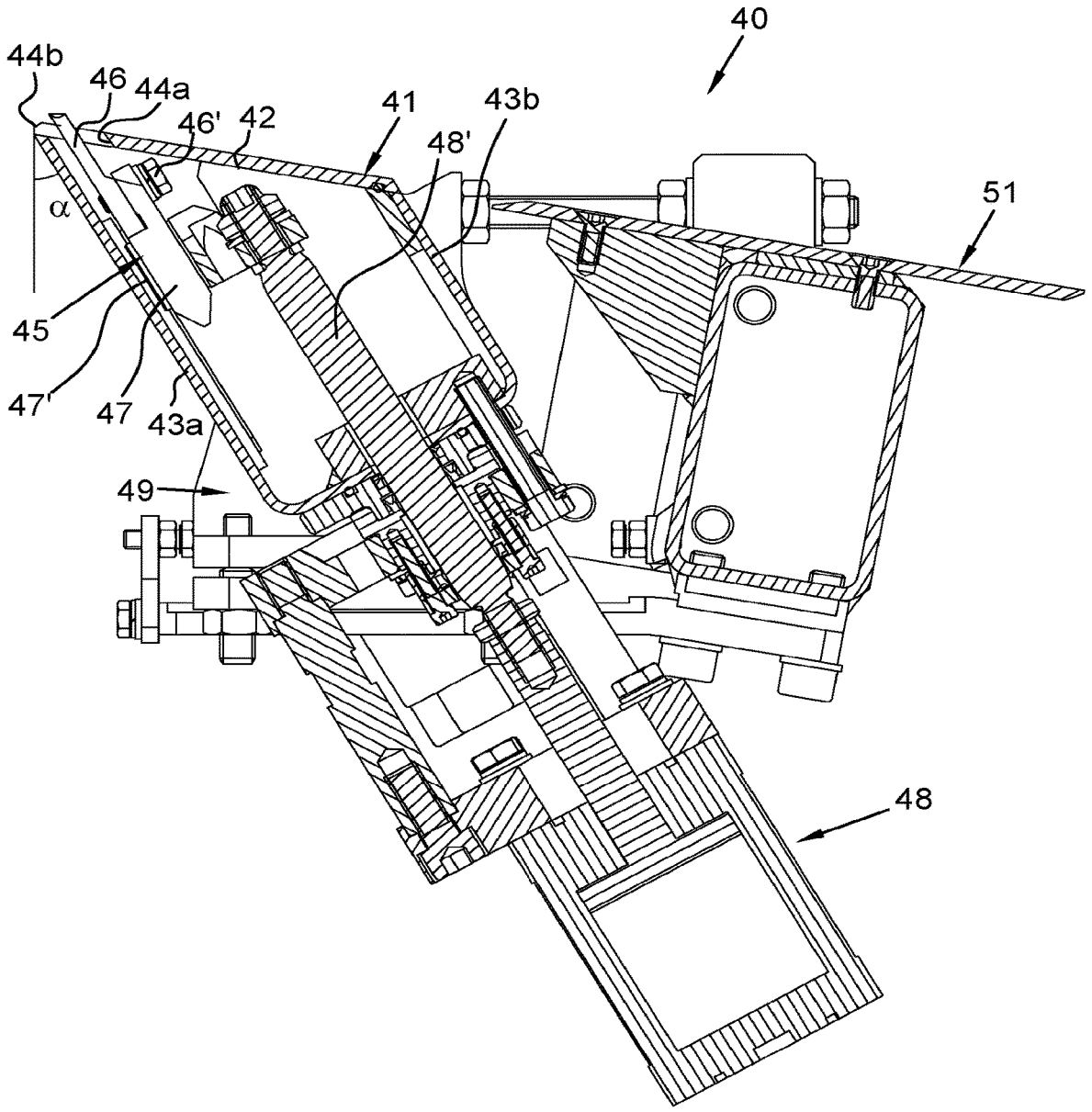
FIG. 2 is an enlarged view of a detail of FIG. 1 showing the glue dispensing assembly.
Figure 3:
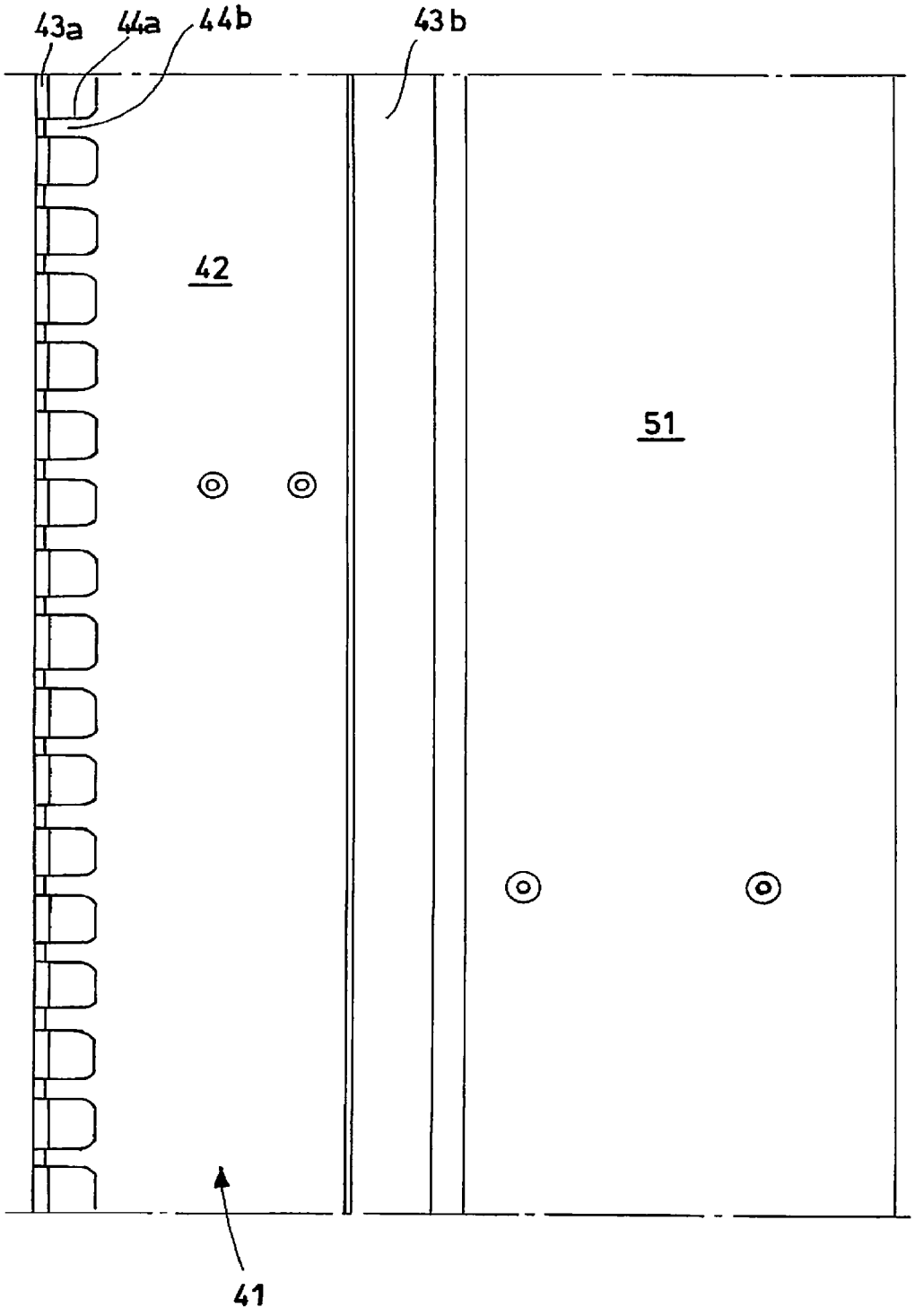
FIG. 3 is a top view of the detail shown in FIG. 2.

With reference to the figures, a gluing device of an end edge of a log is shown, indicated overall with 10, shown comprehensively in FIG. 1.

In the gluing device of an end edge 10 according to the invention, on an infeed side of a load-bearing structure comprising two side walls 12, there is an inclined feeding plane 13 to feed the logs 11, that are provided with a free end edge 11' and are coming from a preceding rewinding machine (not shown) positioned upstream.

In succession, from upstream to downstream following the transfer of the logs 11, the gluing device of an end edge 10 comprises an introduction assembly 20 of the logs 11 one after the other, a handling assembly 30 of the logs 11, a glue dispensing assembly 40 and a transfer assembly 50 of the logs 11.

On an outfeed side of the gluing device 10, opposite to the infeed side, an inclined discharge plane 14 transfers the logs 11, that are provided with a glued end edge 11' towards a subsequent cutting station (not shown).

As an example of embodiment, the introduction assembly 20 may comprise an intermittent rotating selection device 21, of the star type, equipped in the example with four receiving elements, which receive the infed single logs 11 and transfers them to the outfeed one after the other towards the handling assembly 30.

The handling assembly 30 of the logs 11 comprises a pair of rollers 31 and 32 arranged one on top of the other, respectively an upper handling roller 31 and a lower handling roller 32, equipped with independent motorisation to impose the rolling on the log 11 without transfer, as well as the transfer beyond them. The handling rollers 31 and 32 have the task of both unwinding the end edge from the log to allow the dispensing of glue and rewinding it after the dispensing of glue.

In particular, the pair of handling rollers 31 and 32, while imposing on the log 11 a rolling without transfer to unwind the end edge 11', collaborates with a series of air nozzles 33, positioned above, which open the end edge 11' from the log 11 and spread it on a surface positioned immediately downstream of the lower handling roller 32 in a position beneath a log transfer plane 11.

According to the preferred embodiment shown of the invention, this surface is constituted by a lower suctioned plane 34, positioned immediately downstream of the lower handling roller 32, in a position beneath said transfer plane 51.

The suctioned plane 34 comprises a sequence of sheet metal lengths each shaped according to a first portion with a radius of curvature equal to the radius of the lower roller 32 and a second flat portion placed along a vertical plane of the device.

Between the lower handling roller 32 associated with the suctioned plane 34 and the transfer plane 51 there is a transverse slot 35 for the passage of the end edge 11' positioned immediately downstream of the lower handling roller 32.

In the gluing device 10 according to the invention the glue dispensing assembly 40 is placed in series between the lower handling roller 32 and said transfer plane 51.

The glue dispensing assembly 40 comprises a transverse tank 41 containing glue, housing cyclically movable glue transfer members 45.

The glue transverse tank 41 has a transverse extension equal to the maximum possible width of the logs being processed, having to guarantee the dispensing of the glue as close as possible to the end edges of the logs.

The transverse tank 41 is equipped with an upper cover 42, positioned in abutment between a front wall 43*a* and a rear wall 43*b* of the tank 41.

The upper cover 42 is arranged on the same plane as the transfer plane 51.

The upper cover 42 of the transverse tank 41 is equipped with a plurality of openings 44*a* arranged in succession side by side at a set distance along a transverse row. The openings 44*a* are separated from each other by bridge elements 44*b*, forming a "comb" structure that is able to establish a continuity of the cover along the whole transverse extension. This thus certainly prevents the unwound edge 11' from accidentally falling inside the glue tank, even for logs 11 of small diameter, which are the most critical case. In fact, the tank has openings 44*a* which allow the blade to move outwards but do not allow the edge 11' to enter inside during the edge opening and searching phase.

The movable glue transfer members 45 comprise a plurality of tips 46 arranged in succession along a transverse row, alternatively projecting through the relevant openings 44*a* and retracted within the tank 41 because of the cyclical movement.

The plurality of tips 46, according to the preferred embodiment shown, is applied above a transverse bar 47, made from a single piece or preferably through a succession of a plurality of lengths. The transverse bar 47 is contained in the tank 41 and has the maximum possible transversal extension. The transverse bar 47 is constrained to at least a linear actuator 48, preferably a linear actuator 48 at each opposite end. The linear actuators 48 are arranged in a position beneath the tank 41 and have a piston 48' with sealed passage inside the tank 41.

Figure 4:
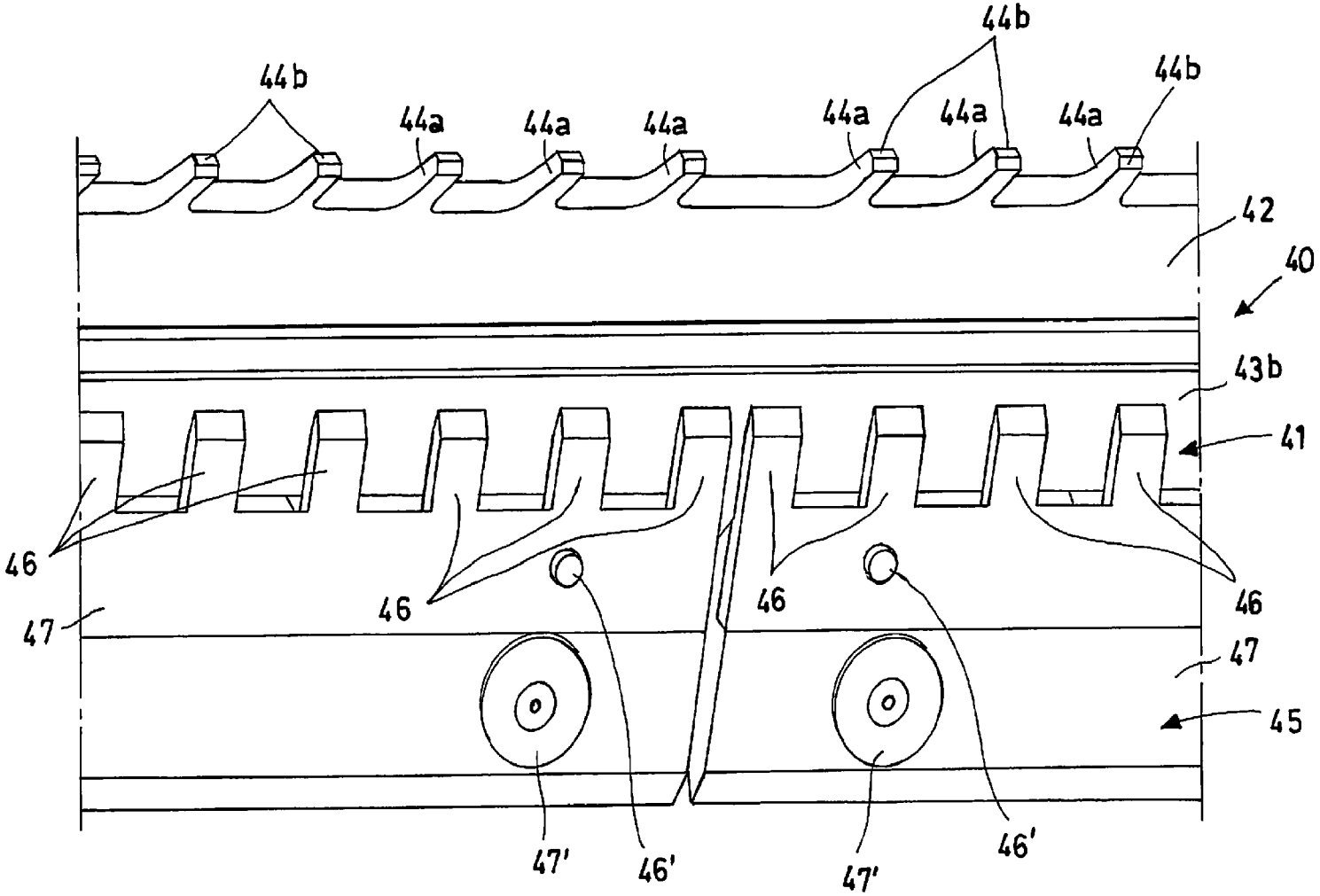
FIG. 4 is an exploded view of the detail shown in FIG. 2.

According to what is shown in FIG. 4, there may be several lengths of transverse bar 47, each one provided with constraining means 47' to the linear actuators 48.

The tips 46 are for example made as inserts, each bearing a plurality of tips 46, applied by means of bolts 46' to the lengths of transverse bar 47.

Preferably, the transverse row of openings 44*a* is placed near the side in abutment of the cover 42 with the front wall 43*a* of the transverse tank 41. This allows the protrusion of the tips 46 for dispensing the glue as close as possible to the edge 11' unwound in the transverse slot 45.

To make available a volume 135 in the area comprised between the suctioned plane 34 and the tank 41, beneath the increased transfer plane, the tank 41 has the front wall 43*a* inclined at an angle $\alpha$ equal to at least 30°, preferably 45°, in relation to the vertical of the machine. In the example shown, the rear wall 43*b* is arranged parallel to the front wall 43*a*. The increased volume 135 facilitates the introduction of the end edge 11' below the transfer plane through the transverse slot 35, in particular in the case of end edges 11' of maximum length.

To allow the adjustment of the width of the transverse slot 35 according to the diameter of the log 11 being processed, the transverse tank 41 is movably mounted along the longitudinal advancement direction of the log to be moved closer to or away from the lower roller 32. Preferably, the transverse tank 41 for the adjustment of the width of the transverse slot is mounted on a slide 49, driven by a linear actuator with a longitudinal excursion for example of 10-20 mm.

The gluing device according to the invention 10 comprises detection means of said end edge which, according to the preferred embodiment shown, consist of photocells 36, arranged substantially parallel to the transfer plane or in a horizontal position in relation to the base of the machine, which detect the presence of the end edge 11' on the suctioned plane 34 according to a predetermined length for controlling the dispensing of glue and the rewinding by means of the handling rollers 31 and 32.

The log transfer assembly 50 comprises, downstream of the transfer plane 51 placed at the exit from the glue dispensing assembly 40, a pair of pressure rolls 52 and 53, arranged one on top of the other and independently motorised in order to produce pressure for gluing and the possible phasing of the glued end edge 11' according to the subsequent processing station positioned after the discharge plane 14.

According to methods known, in the gluing device 10 according to the invention the upper handling roller 31 is mounted on a height-adjustable slide 15, shown in FIG. 1 in the raised position. Furthermore, the upper handling roller 31 also constitutes the return roller of a series of infeed belts 16 and of a series of outfeed belts 17, positioned above to facilitate respectively the transfer of the logs 11 from the introduction assembly 20 to the pair of handling rollers 31 and 32, as well as the subsequent transfer towards the transfer plane 51. According to a further embodiment, not shown, these series of upper belts 16 and 17 could be made as a series of a single belt, or could be wholly or partly omitted.

"Log transfer plane", represented by a dash-dotted line F in FIGS. 5A-5D, does not refer to a material element but rather a succession of surfaces that support the logs 11 in transfer through the gluing device 10.

In the example, the transfer plane comprises the upper cylindrical directrix of the lower handling roller 32, the cover 42 of the glue transverse tank 41 and a transfer plane 51, inclined in the example, positioned downstream of the pair of rollers 31 and 32 and the glue dispensing assembly 40.

Figure 5A:
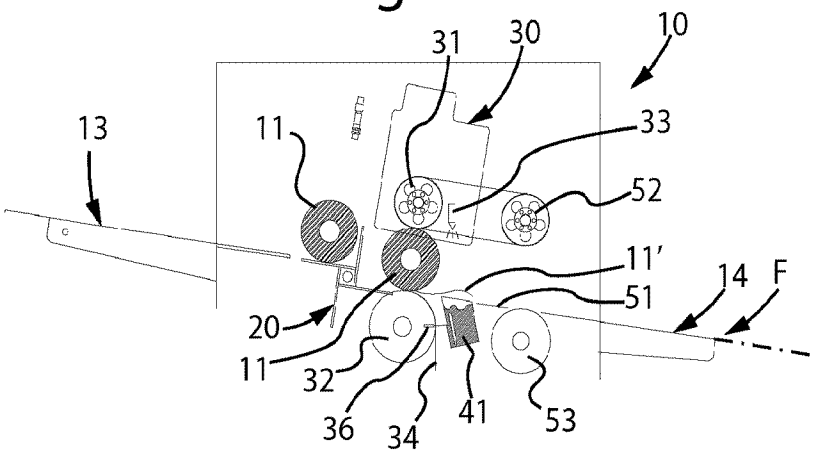
Figure 5B:
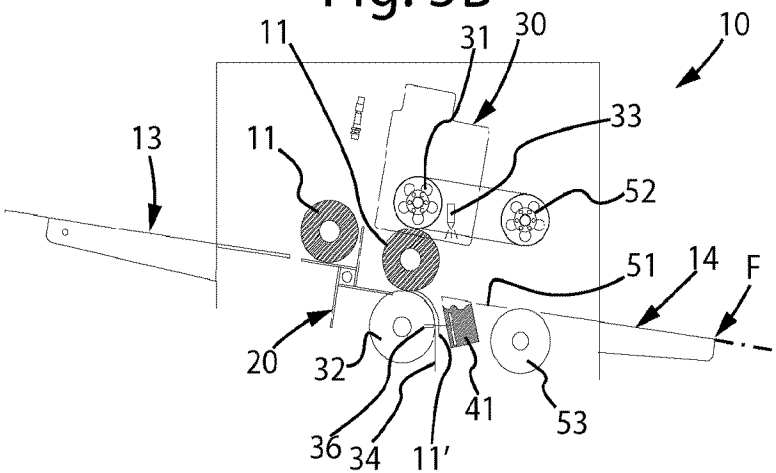
Figure 5C:
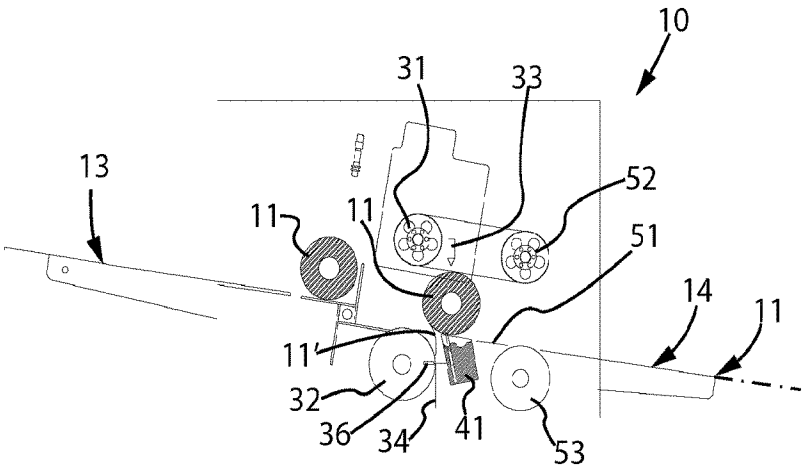
Figure 5D:
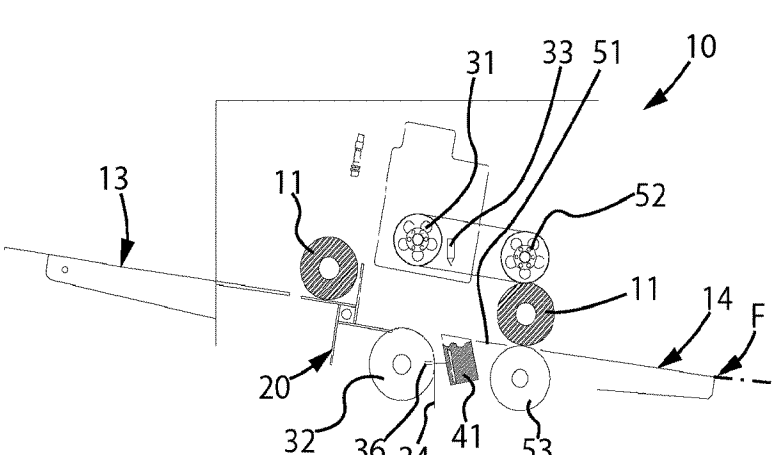

In the gluing device 10 of the end edge 11' of a log 11, according to the present invention, each log 11 fed into the gluing device of the end edge 10 is subjected to the following steps in succession, before being discharged from it, as shown schematically in FIGS. 5A-5D:

opening and unwinding of the end edge 11' between the pair of handling rollers 31 and 32 with the aid of nozzles 33 dispensing an air blow from above (FIG. 5A);

introduction of the open end edge 11' in the volume 135 beneath the log transfer plane through the transverse slot 35 and spreading of a set length of the end edge 11' on the lower suctioned plane 34; detection of the end edge 11' by photocells 36 placed in the volume 135 (FIG. 5B);

transfer of the log 11 exiting the pair of handling rollers 31 and 32 and dispensing of the glue by rolling the log 11 on the plurality of tips 46 bearing glue placed in an extracted position relative to the cover 42 of the glue transverse tank 41 (FIG. 5C);

rewinding of the end edge 11' and transfer to the log 11 of a pressure for performing the gluing via the pair of pressure rolls 52 and 53 (FIG. 5D);

transfer of the log on a transfer plane 51 exiting the gluing device of the end edge 10.

In FIG. 5B for the sole purpose of graphical representation, the end edge 11 is shown slightly distant from the lower curved plane 34, rather than adhering to it.

The next log 11 is then introduced into the handling assembly 30 when the previous log 11 with the glued end edge 11' is on the transfer plane 51.

The gluing device of an end edge of a log and the relative gluing method which is the subject matter of the present invention have the advantage of allowing gluing very rapidly. In fact, the gluing device is very compact, with few transfers between few subsequent processing assemblies.

Another advantage concerns the possibility to minimise the distance between the dispensing of glue and the suctioned plane, to optimise the processing of logs with small diameter.

Furthermore, advantageously, the risk of accidental introduction of the free end 11' into the glue transverse tank 41 is eliminated, which would be even more accentuated the closer the transverse tank 41 is to the lower handling roller 32. Thus the distance between the transverse tank 41 and the handling roller 32 can be minimised without affecting the efficiency of the gluing device.

The gluing device of an end edge of a log conceived herein is susceptible to numerous modifications and variations, all falling within the invention; furthermore, all details are replaceable by technically equivalent elements. In practice, the materials used, as well as the dimensions thereof, can be of any type according to the technical requirements.

The invention claimed is:

1. A gluing device of an end edge of a log comprising in succession:

an introduction assembly into said gluing device of said logs one after the other;

a handling assembly for said log associated to detection means of said end edge, the handling assembly including a pair of rolls provided one above the other, said pair of upper and lower rolls being selectively for advancement and holding in rotation said log;

a glue dispensing assembly; and a transfer assembly of said log, the transfer assembly including a transfer plane, wherein the gluing device has a transverse slot through which the end edge of the log passes, provided immediately downstream of the lower handling roll, wherein said glue dispensing assembly is placed in series between said lower handling roll and said transfer plane and includes a transverse tank for the glue, housing cyclically movable glue transfer members, wherein the transverse tank is provided with an upper cover in abutment with a front wall and with a rear wall of said transverse tank, wherein said upper cover is provided with a plurality of openings provided in succession side by side at a set distance apart along a transverse row of the upper cover, and wherein the movable glue transfer members comprise a plurality of tips provided in succession along a transverse row, the plurality of tips alternatively projecting respectively through the plurality of openings and retracted within the transverse tank due to the cyclical movement wherein said transverse tank is movably mounted along the advanced longitudinal direction of the log to be moved closer to or away from the lower roller to adjust the width of the transverse slot.

2. The gluing device according to claim 1, wherein said plurality of tips is applied above a transverse bar, said transverse bar being constrained to at least one linear actuator.

3. The gluing device according to claim 1, wherein said transverse row of openings is provided near the side abutting with the front wall of the transverse tank.

4. The gluing device according to claim 1, wherein said transverse tank has said front wall inclined at an angle $\alpha$ of at least 30°, with respect to the vertical of the device.

5. The gluing device according to claim 1, wherein said upper cover is provided in the same plane of the transfer plane.

6. The gluing device according to claim 1, wherein said transverse tank is mounted on a slide driven by a linear actuator.

7. The gluing device according to claim 1, wherein said handling assembly comprises a lower suctioned plane, placed immediately downstream of said lower handling roller in a position under the transfer plane.

8. The gluing device according to claim 7, wherein said suctioned plane comprises a sequence of sheet metal lengths each shaped according to a first portion with a radius of curvature equal to the radius of the lower handling roller and a second flat portion placed along a vertical plane of the device.

9. The device according to claim 8, wherein said means for detecting said end edge comprise photocells, able to detect the presence of said end edge on said suctioned plane according to a predetermined length for controlling the dispensing of glue and the rewinding of said end edge with said handling rollers.

* * * * *